US005769504A

United States Patent [19]

Maity et al.

[11] Patent Number: 5,769,504

[45] Date of Patent: Jun. 23, 1998

[54] EQUIPMENT FOR SHORTWALL MINING USEFUL FOR EXTRACTION OF PILLARS IN UNDERGROUND COAL MINES

[75] Inventors: Sibnath Maity; Bharat Bhushan Dhar; Sibnath Mukherjee, all of Bihar, India

[73] Assignee: Council of Scientific & Industrial Research, New Delhi, India

[21] Appl. No.: 613,297

[22] Filed: Mar. 11, 1996

[51] Int. Cl.[6] ..... E21D 23/03; E21C 41/16

[52] U.S. Cl. ..... 299/11; 405/296; 299/19

[58] Field of Search ..... 299/10, 11, 18, 299/19, 42, 43; 405/296

[56] References Cited

U.S. PATENT DOCUMENTS

| | | | |
|---|---|---|---|
| 3,848,420 | 11/1974 | Allen et al. | 405/293 |
| 4,041,714 | 8/1977 | Allen | 405/296 X |
| 4,268,088 | 5/1981 | Price et al. | 299/11 |
| 4,526,495 | 7/1985 | Becker et al. | 405/299 |
| 4,747,729 | 5/1988 | Urschitz | 405/296 |
| 5,368,369 | 11/1994 | Maity et al. | 299/1 |

FOREIGN PATENT DOCUMENTS

| | | | |
|---|---|---|---|
| 1533736 | 1/1970 | Germany . | |
| 3238256 | 4/1984 | Germany . | |
| 1408069 | 7/1988 | U.S.S.R. | 299/11 |
| 2048352 | 12/1980 | United Kingdom . | |
| 215210 | 7/1985 | United Kingdom . | |

*Primary Examiner*—David J. Bagnell
*Attorney, Agent, or Firm*—Ladas & Parry

[57] ABSTRACT

Shortwall mining equipment for extraction of some pillars in an underground coal mine has a series of self-advancing powered roof supports (1) for placement along the pillars (2) under extraction, the pillars under extraction being located within a panel (3) which is surrounded by barrier pillars (4), an armoured face conveyor (5) fixed to the barrier pillars, a light duty chain conveyor (18) and a belt conveyor (19). Each of the self-advancing powered roof supports (1) has at a goaf end a support mechanism (6) on a base frame (14) with a side shield (7) and hydraulic ram side arms (10). The base frame (14) is provided with front and back side hooks (11 & 12) to facilitate pulling of the support mechanism (6). The armoured face conveyor (5) is provided with a shearer (15) having a cutter drum (16) coupled with a centrally located ranging arm (17), an outbye end of he armoured face conveyor (5) being at a right angle to and set upon the light duty chain conveyor (18) as a freely advancing bridge. A light duty chain conveyor (18) is connected to the belt conveyor (19) at an outbye of the panel (3).

1 Claim, 4 Drawing Sheets

EQUIPMENT FOR SHORTWALL MINING USEFUL FOR EXTRACTION OF PILLARS IN UNDERGROUND COAL MINES

FIELD OF THE INVENTION

This invention relates to an improved equipment for shortwall mining useful for extraction of pillars in underground coal mines. In coal mines, generally coal seams are initially developed into pillars and cross galleries (roadways). These pillars are subsequently extracted which is called depillaring.

BACKGROUND OF THE INVENTION

In the initial stages of shortwall mining, coal seams are developed into pillars and cross galleries. Thereafter, the pillars are extracted one by one or in a staged manner by a process called depillaring.

PRIOR ART REFERENCES

In general, bord and pillar depillaring is done in conventional methods with conventional equipment sometimes, intermediate technologies with side discharge loaders (SDLs) and load haul dumpers (LHDs) are being used for extraction. There is another system of exploiting coal seams in long pillars with the help of self-advancing powdered roof supports, continuous cutters, loaders and conveyors from the face to the outbye. The long blocks are developed in a different way, this is called longwall mining.

The total system of longwall mining, its uses and an improved longwall equipment for further mechanisation as has been claimed in an earlier U.S. Pat. No. 5,368,369 is referred in this connection.

In DE 3633658 (GEW EISENHTTE WESTFALIA) a control system for a shortwall underground mining machine with a T-shaped conveyor. has been disclosed in which the movement and control units are spaced on a base frame, each with an advancing and an anchoring ram and such unit has a guide housing coupled via a universal joint to the base frame. In other words, the above German. Patent discloses a sort of movement control system of a particular shortwall underground mining machine, which does not any way remotely relate to the present invention.

In another German Patent (DE 3609557) an additional flap system for a shortwall cutting machine against sidewall has been disclosed. However, the subject matter disclosed therein does not anyway relate to the system of shortwall mining claimed in the present application.

Another Swiss Patent (SU 1177473) dated 7th Sep. 1985 provides a machine consisting of body and tooling composed of a vertical break-out and loading chain with cutters, flights, drive and return sprockets as well as guide and loader. It should be supplemented by a discharge chute mounted on the chain guide above the top strand. The radius of the guide should be defined by the inside edge of the chain flights. In fact, this patent discloses a sort of device for raising coals from cutting machine and also keeping the machine moving, however, this patent in no way relates to the system covered in the present invention of the applicants.

Yet another German patent (DE 3340606) covers machine for more rapid alignment, steering and tracing of shortwall mining and does not cover or even envisage the shortwall equipment system disclosed and claimed in the present invention.

Still another German patent (DE 3340605) dated 23rd May 1985 relates to a component structure which permits reliable tilt free guidance for the heavy cutter arm of shortwall machine and such structure does not envisage any of the claims of the present invention.

Another Swiss patent (SU 1120109) provides a mobile shield with flexible canopy consists of props rigidly interconnected by crossbars and with their top ends bent towards the face and joined together by a stringer, with rollers secured, by flexible suspension to the bottom ends of the props. The waste shield has cantilevered thrusters rigidly joined to the respective shield props and also has vertical frames which are rigidly joined to one another and which have top and bottom rollers complete with shock absorbers and arrest shoes joined to the frames by hydraulic control jacks. This patent discloses hydraulic shortwall mining and in no way remotely relating to the present invention.

One more Swiss patent (SU 1086179) and U.S. patent (U.S. Pat. No. 4,268,088) disclose a machine with conveyor usinghorizontal endless conveyor and odd and even sections with power sleeves controlled advance, and a method or manner of shortwall mining of trona ore respectively. These patents also do not relatc to or even envisage the scope and the subject matter of the present invention. Further, there is no prior art which teach a safe, continuous and proper extraction of pillars Therefore, there is a need for continuous cutting, loading and conveying system with such an appropriate layout of self-advancing powered roof supports for pillar extraction in shortwall mining. In addition, as such, a long wall equipment package cannot be used in a short form for existing pillar extracting. Therefore, it necessitates a shortwall equipment package with an appropriate layout for extraction of pillars in a bord and pillar panel.

SUMMARY OF THE INVENTION

The invention provides a system for continuous cutting, loading and conveying a layout of self-advancing powered roof supports appropriate for pillar extraction in shortwall mining The object of the present invention is to provide an equipment for shortwall mining useful for extraction of pillars in underground coal mines. Another object of the present invention is to provide an appropriate layout for extraction of coal from existing pillars with the help of improved mechanized device.

Yet another object of the present invention is to provide an appropriate support system in the panel layout in addition to the face support system.

A further object of the invention is to provide a transport layout for the short face equipment system to take the extracted coal to the inbye side of the panel.

The drawbacks of the available devices are that there is no appropriate powered roof support at the end of the face towards goaf sides. The powered support as generally available is having rear shield and top canopy as shown in FIG. 3 of the drawings accompanying this specification, but it does not have any side protecting shield to resist the loose rock load from goaf side. Secondly, there is no appropriate layout for extraction of developed coal pillars with the shortwall face equipment alongwith its feasible cutting, loading, transporting and supporting system. There is no proper combination of equipment with innovative layout for extraction of short block of coals in underground mines.

The present invention provides a novel combination of interdependent means to form a system for the extraction of coal from the pillars located in underground coal mines.

BRIEF DESCRIPTION OF THE DRAWING

The equipment of the present invention is shown in FIGS. 1 to 6 of the drawings accompanying this specification.

DESCRIPTION OF EMBODIMENTS

Figure 1:
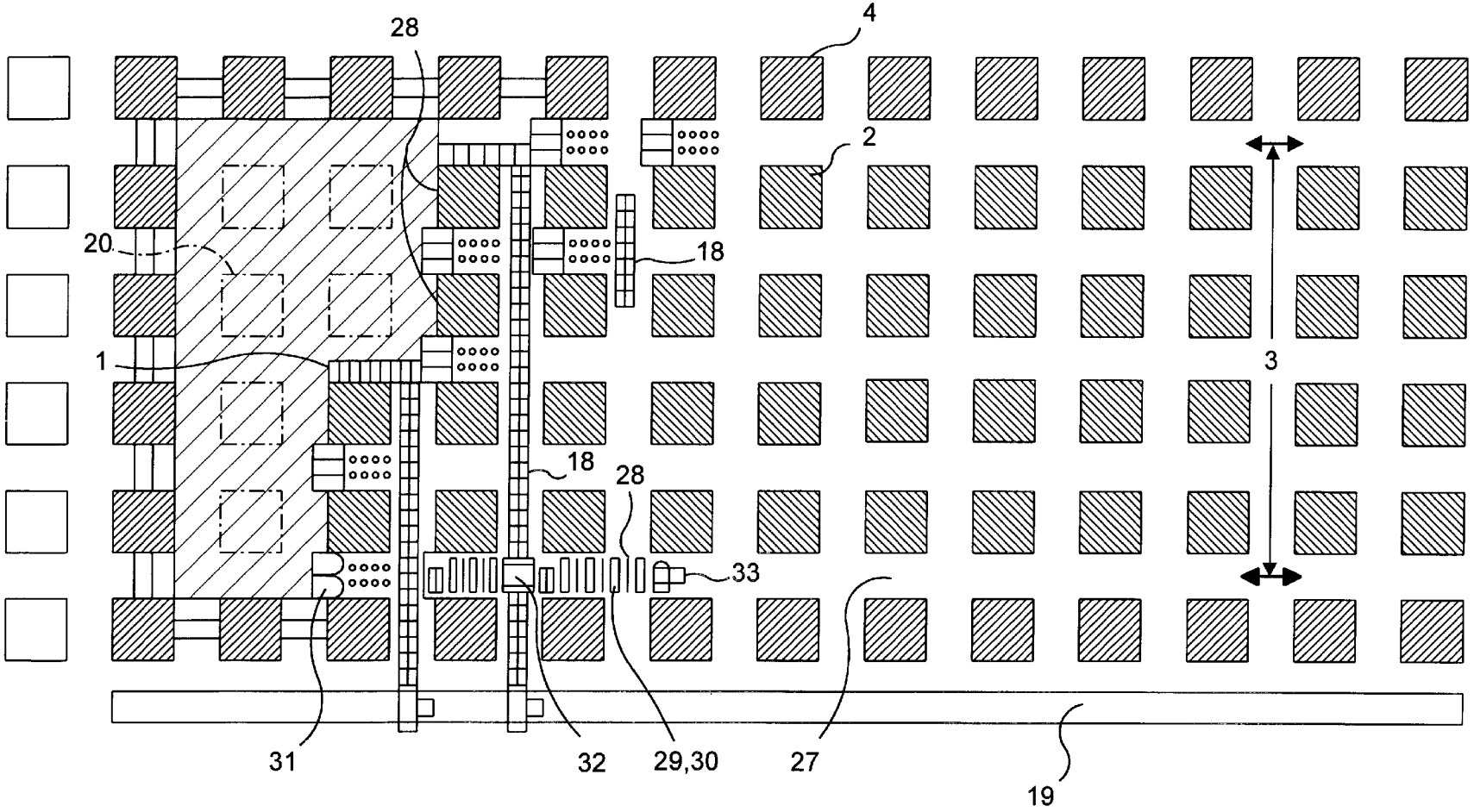
FIG. 1 shows the complete layout of the panel under extraction showing the face, equipment layout, and conveyor layout from the face to the outbye.

Accordingly, the present invention provides an equipment for shortwall mining useful for extraction of pillars in underground coal mines, the equipment comprising a series of self-advancing powered roof supports (1) being placed along pillars (2) under extraction. The pillars under extraction are located within a panel (3), which is surrounded by barrier pillars (4). An armoured face conveyor (5) is fixed to said barrier pillars.

Each of the self-advancing powered roof supports (1) has at its goaf end a support mechanism (6) on a base frame((14) with attachments like a side shield (7) including a plate (8), and hanging steel guards (9), hydraulic ram side arms (l0), a front side hook (11) and a back side hook (12). The side shield (7) is hung from a canopy (13) on the top of the support mechanism (6). Two or more of the hanging steel guards (9) are freely hung from the inner side of the side shield (7). The hydraulic ram side arms (10) are horizontaUy fixed within the structure of support (6) to support mechanism the side shield (7). The base frame (14) is provided with the front and back side hooks (11 & 12) to facilitate pulling of the end support mechanism (6). The armoured face conveyor (5) provided with a shearer (15) having a cutter drum (16) coupled with a centrally located ranging arm (17), the outbye end of the armoured face conveyor (5) having a drive head and being at a right angle to and set upon a light duty chain conveyor (18) like a freely advancing bridge. The light duty chain conveyor (18) is connected to a belt conveyor (19) in the outbye of the panel(3).

The use of the equipment of the present invention is as follows:

Two sets of face equipment (1, 5, & 15) along with light duty conveyor (18) being in use in front of goaf (20) for extraction of two rows of pillars (2), the said light duty chain conveyors (18) being laid along the cross galleries (21) by the side of the armoured face conveyor (5) face, the open end of the level galleries (22) being supported with skin to skin cogs (23) at the goaf edges (26), the goaf (20) being the extracted areas the junctions of cross gallery (21) and level gallery (22) being supported by plurality of cogs (23) and hydraulic props (24) upto two pillars ahead of the goaf, the general level galleries (22) being supported by two rows of hydraulic props (24) and bars (25) upto the two pillar ahead of goaf edge (26), the immediate two cross gallery in front of goaf where the light duty chain conveyors being laid in, being supported by two rows of hydraulic props and bars (24 & 25) on both side of light duty chain conveyor in a staggered manner, the last level gallery (27) at the belt conveyor (19) side of the panel being supported by rows or hydraulic props (24) and girders (28) as goal post support alongwith roof bolts (29) and W-straps (30) as supplemented in between the rows of girders, the goal side end of the said level gallery (27) being supported by at least two chock shields (31) and the junctions of the same gallery not being supported by the cogs (23) rather by the plurality of hydraulic props (24) with girders (28) placed skin to skin near to the junctions, in the same level gallery (27) the portion of the second light duty chain conveyor covered by a steel structure bridge (32) sloping on its both side, a winch (33) being provided at a distance in the same gallery to be connected by ropes with the hooks (11&12) of the goaf end shield (6).

Figure 2:
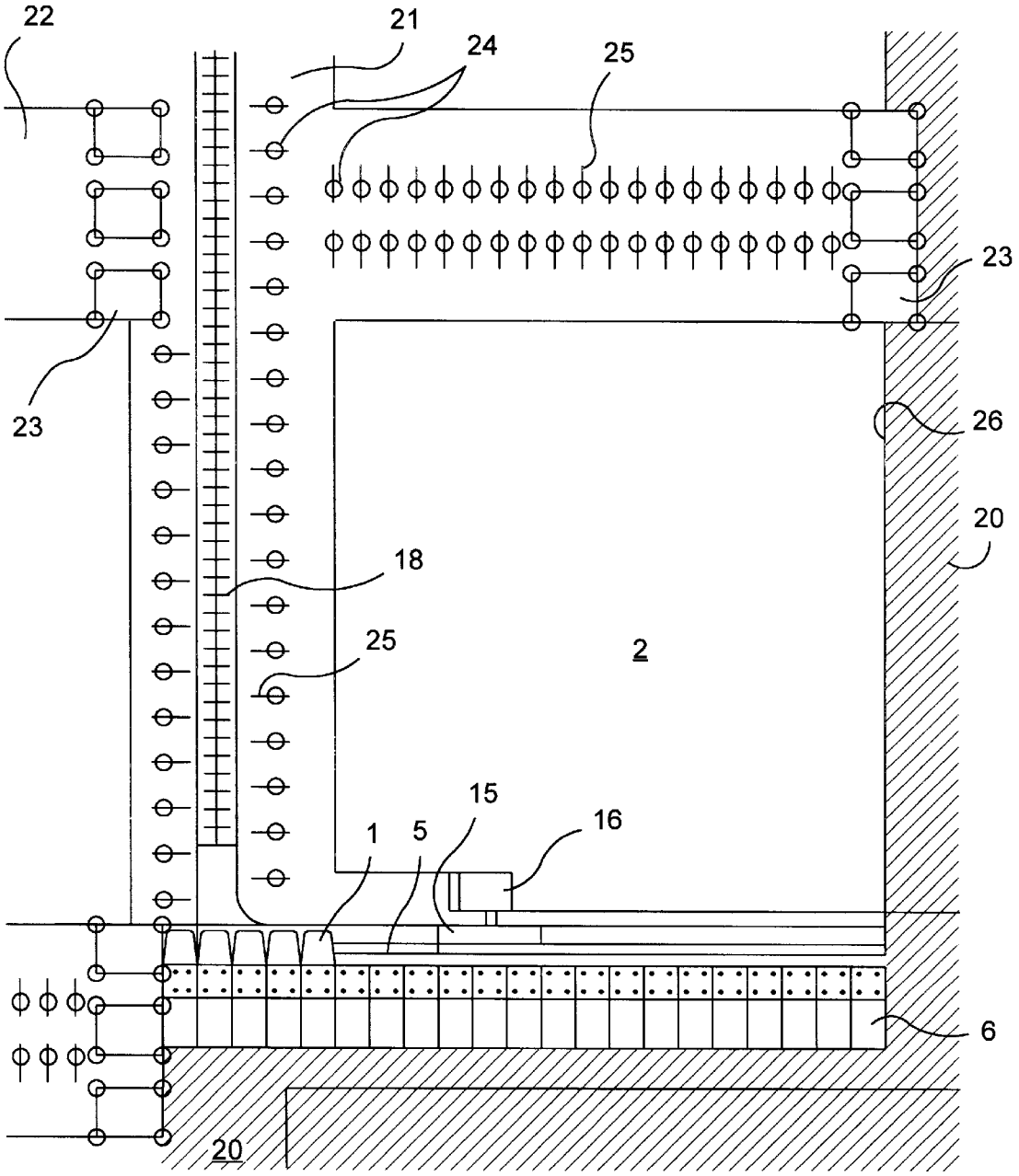
FIG. 2 shows the distinct face equipment with self-advancing powered supports, shearer, armoured face conveyor, bridging system and the light duty chain conveyor at the face end and also showing the junction and gallery supports.
Figure 3:
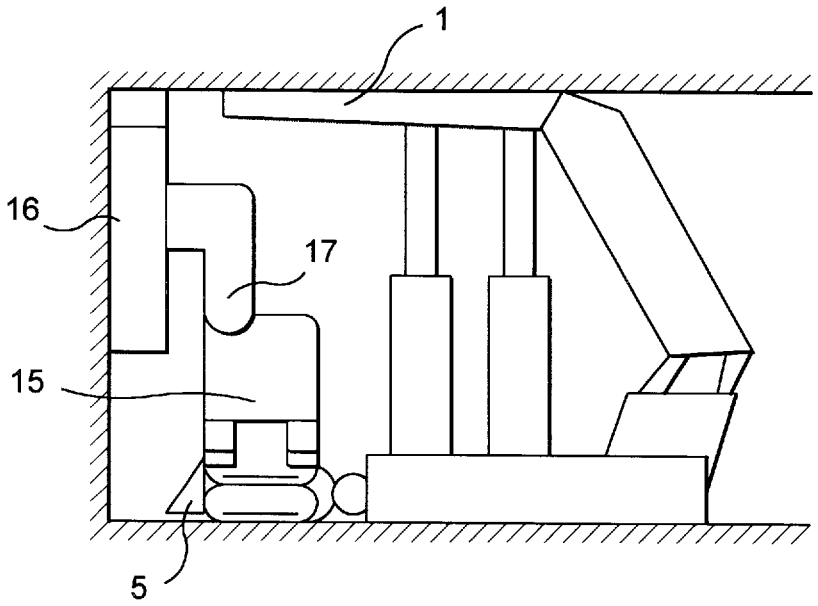
FIGS. 3 and 4 show rear elevational views; of the shearer with its cutter drum, general face supports (chocks), armoured face conveyor and light duty chain conveyor layout with an end shield support in FIG. 3.
Figure 4:
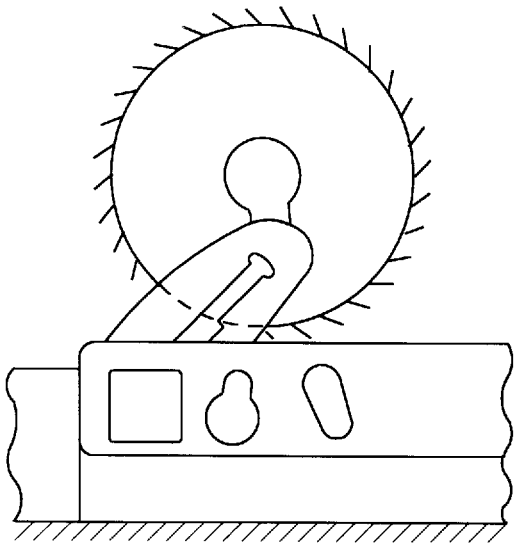
Figure 5:
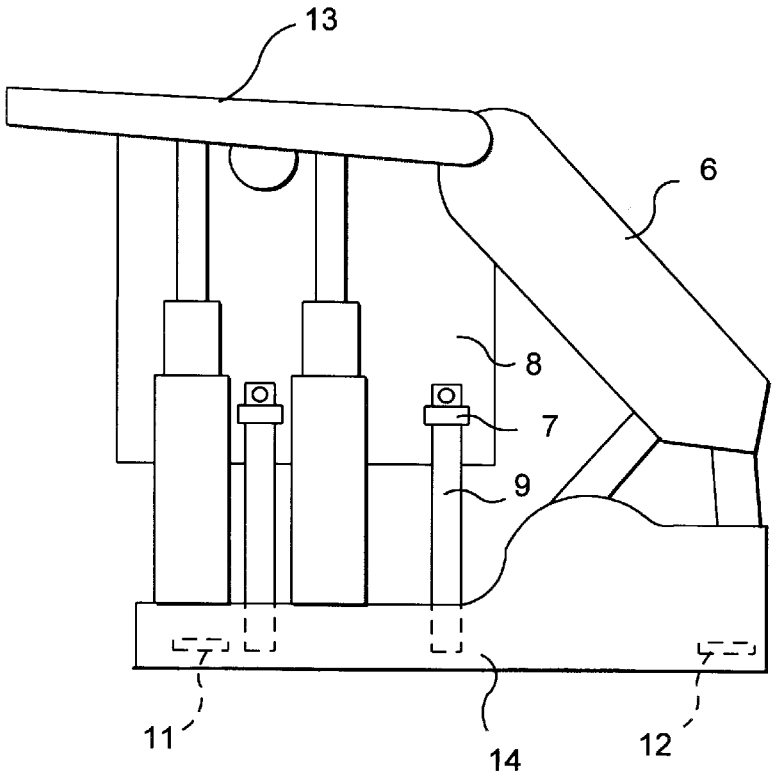
FIGS. 5 and 6 show side and rear elevational views of the end shield support.
Figure 6:
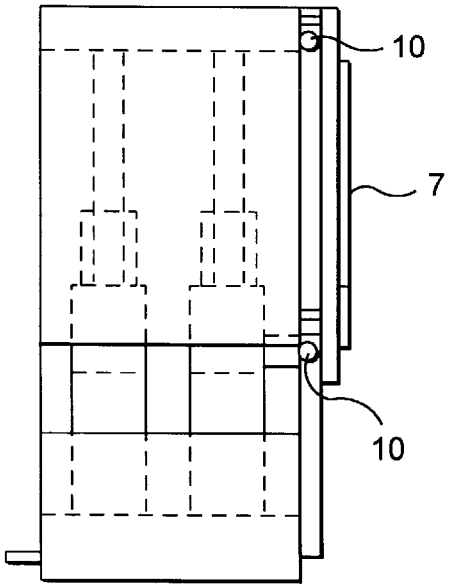

The equipment of the present invention is mainly a device for cutting of coal from the existing pillars (2) by a cutter (15) (ref. FIG. 2), and loading of same by an armoured face conveyor (5) (ref. FIG. 2), being supported by a series of self advancing powered roof supports (1) (ref. FIGS. 1 & 2) in a row such that the length of the combined supports is equivalent to that of the pillar width (say 30 m). The coal being cut by shearer is conveyed by AFC from the face and then off loaded to the light duty chain conveyor which is laid through the cross gallery in front of the face. This light duty chain conveyor (18) transfers coal to the belt conveyor (19) which is laid in the level gallery beyond the barrier pillars and in turn transfer coal to the trunk belt conveyor of main outbye. There is another set of same equipment with a series of powered roof supports (1) shearer (15) and armoured face conveyor (5) and light duty chain conveyor (18) are placed to cut the second line of pillars in a staggered way such that one set will cut in advance in the front line and the other face will follow lagging behind at two pillars or so in the second line. The belt conveyor (19) in the level is common for both the equipment set, i.c. both the light duty cbain conveyors (18) off load coal to the belt conveyor (19). The chock shield support (6) at the goaf end is a specially designed powered roof support for both the working faces, which can bear the thrust of broken rock pieces from the goaf side and provide safety to the working side. In spite of rear shield the end chock has one special side shield arrangement (7,8,9&10) at its right hand side.

The first line of equipment cut the first rows of pillars under the panel (say 4 pillars). The second line of equipment follow the same for the second rows of pillars in a staggered manner as shown in FIG. 1. At the goaf end of the last level (27), the goaf edge is supported by two numbers of more self-advancing powered shield supports (31), instead of cogs as supported in other goaf edges of other levels. Once the extraction is complete for the first row, the equipment are withdrawn with the help of a winch (33) placed in the last level (27) and a bridge (32) placed over the light duty chain conveyor in the second working line. Once the first row pillars are complete the equipment set is withdrawn and installed at the same time to cut the next rows of pillars. There is always a flow of coal to the belt conveyor, as one of the equipment set will continue working in the transition period of withdrawal and installation. The junctions are supported by plurality of cogs in combination with props upto the pillar distance from the goaf edge. The armoured face conveyors is curved at its left hand side and bridging over the light duty chain conveyor such that it can slide upon the intake end of light duty chain. conveyor for a few meters to accommodate a few cuts by the shearer, for which shortening is not required While in operation, after a few cuts when the light duty chain conveyor is required to shorten, the inter-linked pans are withdrawn as per requirement in between the two ends of light duty chain conveyor. The withdrawn pans are installed in the third cross gallery simultaneously.

The main advantages of the present invention:

1. Initial investment is less with high productivity.
2. Cutting, loading and transporting of coal in extraction of existing pillars is possible ith the least man power.
3. Possible to achieve continuous flow of coal in the system, even in the transition period.
4. Percentage of recovery of coal is very high from the reserve.
5. Roof fall and other strata problem can be well controlled by this system.
6. Working personnel are more safe in the depillaring operation by using the present system with having this device and system.
7. It provides facilities for quicker installation or withdrawal of equipment.
8. It is the most economic method (device and layout) considering productivity, safety and recovery.
9. It is suitable for wide range of coal seams.

We claim:

1. Shortwall mining equipment for extraction of pillars in an underground coal mine the equipment comprising:

a series of self-advancing powered roof supports (1) for placement along pillars (2) under extraction, the pillars under extraction being located within a panel (3) which is surrounded by barrier pillars (4);

an armoured face conveyor (5) fixed to said barrier pillars;

a light duty chain conveyor (18); and a belt conveyor (19), wherein each of the self advancing powered roof supports (1) has at a goaf end a support mechanism (6) on a base frame (14) with a side shield (7) including a plate (8) and hanging steel guards (9), hydraulic ram side arms (10), a front side hook (11) and a back side hook (12), the side shield (7) being hung from canopy (13) on a top of the support mechanism (6), at least two of the hanging steel guards (9) being freely hung from an inner side of the side shield (7), the hydraulic ram side arms (10) being horizontally fixed within the support mechanism (6) to support the side shield (7), the base frame (14) being provided with the front and back side hooks (11 & 12) to facilitate pulling of the support mechanism (6), wherein the armoured face conveyor (5) is provided with a shearer (15) having a cutter drum (16) coupled with a centrally located ranging arm (17), an outbye end of the armoured face conveyor (5) being at a right angle to and set upon the light duty chain conveyor (18) as a freely advancing bridge, and wherein the light duty chain conveyor (18) is connected to the belt conveyor (19) at an outbye of the panel (3).

* * * * *